US005193819A

United States Patent [19]

Chen

[11] Patent Number: 5,193,819

[45] Date of Patent: Mar. 16, 1993

[54] DOLL CATCHING TOY

[76] Inventor: Tsan-Ling Chen, No. 14, Hsin Ping Rd., An Ping Industrial Zone, Tainan, Taiwan

[21] Appl. No.: 828,119

[22] Filed: Jan. 30, 1992

[51] Int. Cl.[5] ..... A63F 9/00

[52] U.S. Cl. ..... 273/448; 273/140

[58] Field of Search ..... 273/447, 448, 456, 140; 446/137, 236

[56] References Cited

U.S. PATENT DOCUMENTS 4,214,750 7/1980 Shimizu .

4,298,199 11/1981 Bush et al. ..... 273/448

4,603,860 8/1986 Wey ..... 273/448

4,783,076 11/1988 Lee ..... 273/447

*Primary Examiner*—Mickey Yu

*Attorney, Agent, or Firm*—Bacon & Thomas

[57] ABSTRACT

A doll catching toy has a turning disc, which is rotated by a mechanism set in a receptacle on which the turning disc is fixed. On the turning disc are fixed capped doll containers, whose caps are opened up or closed down at intervals during the time when the disc is rotating, thus permitting a player to fish up a doll by a magnet or hook attached to a line.

3 Claims, 2 Drawing Sheets

DOLL CATCHING TOY

BACKGROUND OF THE INVENTION

An octopus catching game kit of U.S. Pat. No. 4,214,750 has octopus-shaped bodies 13 placed in a receptacle 3, and the octopus-shaped bodies can be raised up at intervals by means of fin-shaped pieces 6 to be fished up with a fishing rod 16 by a player.

A game of U.S. Pat. No. 4,298,199 has a bee as a game piece suspended on a string, and the perianth of a flower as a playing area. The perianth can be opened to permit the bee suspended on a string held by a player to catch up stamens formed as counters, but if the bee should suck up the pistil of a flower formed as a trigger member, the perianth can close to trap the bee.

A fishing-crab toy of U.S. Pat. No. 4,783,076 has crabs placed in round holes in an upper round plate to be turned around and raised by a sloped-up-and-down rail set on a lower immovable plate. When a crab is raised up, its two claws are opened wide for a player to hook it up with a fishing rod.

SUMMARY OF THE INVENTION

The doll catching toy devised in the present invention presents another way of fishing up dolls, and is different from the above mention toys.

The doll catching toy in the present invention has a turning disc provided with a plurality of holes for fixing the same number of doll containers therein. Each doll container has a lower body for placing a doll provided with a magnet at its top and an upper cap to close down or open up at intervals by one of plural sloped rails arranged on the bottom surface of a receptacle on which the turning disc is combined and rotated by a mechanism fixed therein. When one of the doll containers opens its cap, the doll in the container exposes for a certain period of time for a player to fish it up with a fishing rod having a magnet functioning as a hook.

DETAILED DESCRIPTION OF THE INVENTION

Figure 1:
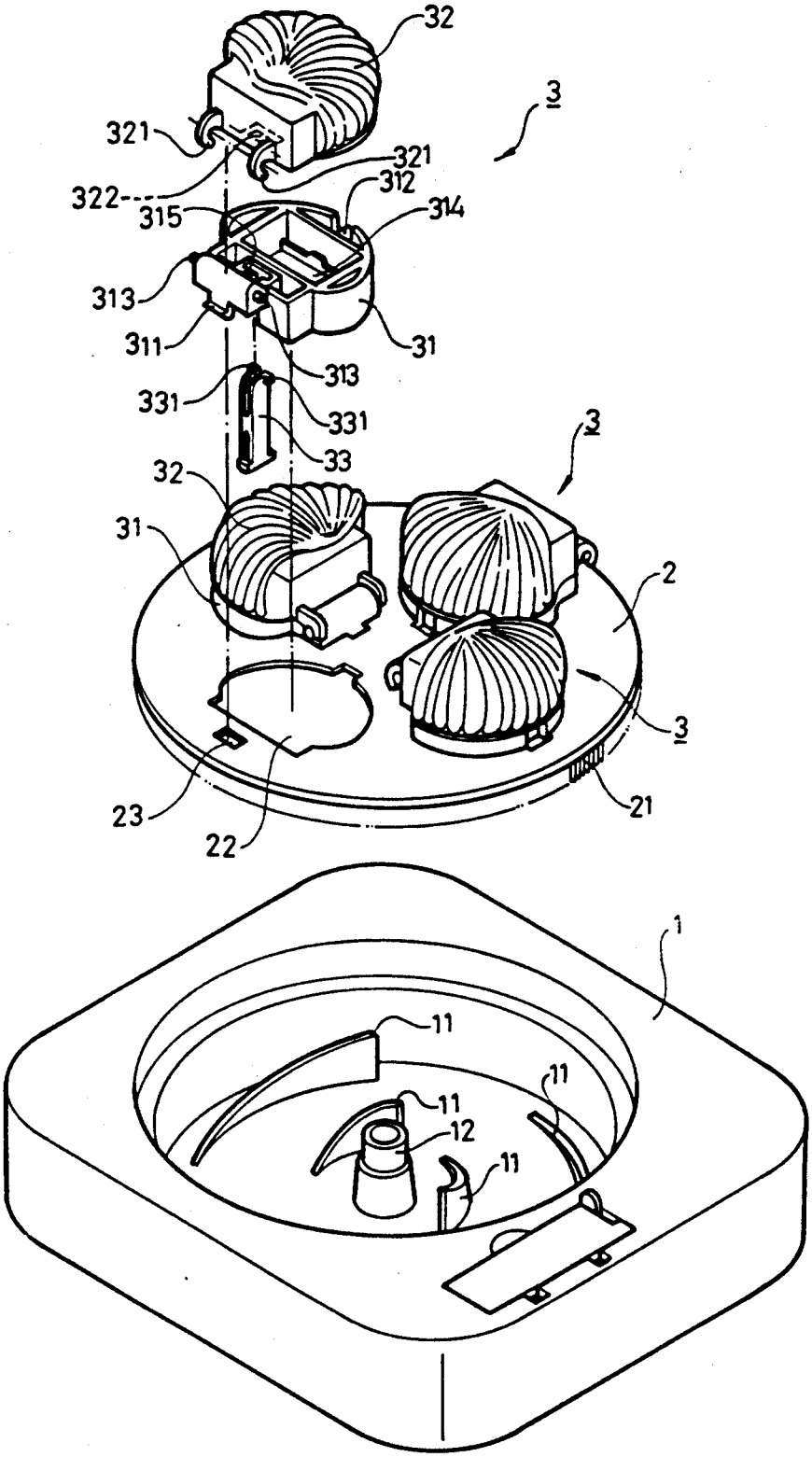
FIG. 1 is an exploded perspective view of the doll catching toy in the present invention.

The doll catching toy in the present invention, as shown in FIG. 1, comprises a conventional receptacle 1, and a moving mechanism (not shown in the drawings), a turning disc 2 to rotate in a definite route inside the receptacle 1, and a plurality of doll containers 3 as the main components.

The turning disc 2 has a shaft at the center to fit in a shaft tube 12 in the receptacle 1 and teeth 21 in the circumferential side to engage with the moving mechanism so that the turning disc 2 may be rotated. The turning disc 2 is also provided with a plurality of large holes 22 spaced apart in the upper surface for the doll containers 3 to be fixed therein, and a combining small hole 23 bored beside each large hole 22 for a hook of each doll container 3 to engage to fix the doll container 3 firmly in each of the large holes 22.

Each of the doll containers 3 has a container body 31 and a cap 32 combined together. The container body 31 has a hook 311 at one side to engage the small hole 23 and a projection at the opposite side to extend in the hole 22 so that the doll containers 3 are fixed firmly in the hole 22. A horizontal shaft 313 is also provided in the container body 31, engaging with two curved hangers 321 in the cap 32 so that the cap 32 may sit on the container body 31 and open up and close down with the shaft 313 as a pivot.

Figure 3:
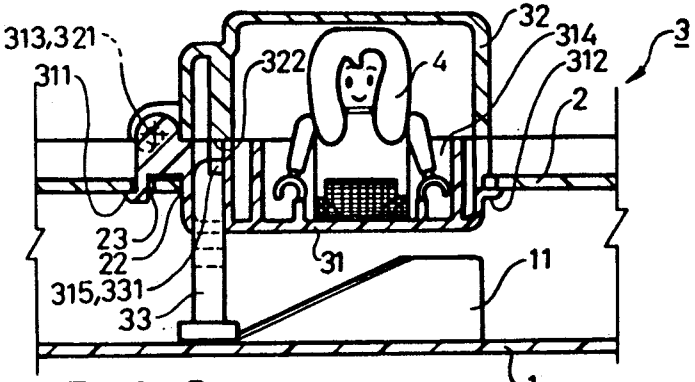
FIG. 3 is a cross-sectional view of line 3—3 in FIG. 2.
Figure 4:
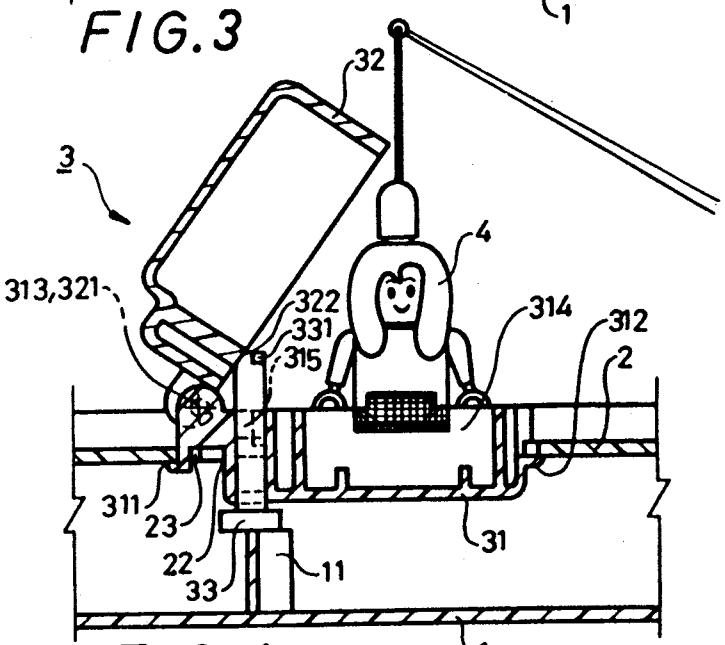
FIG. 4 is a cross-sectional view of the doll catching toy of FIG. 3 in an activated condition.
Figure 2:
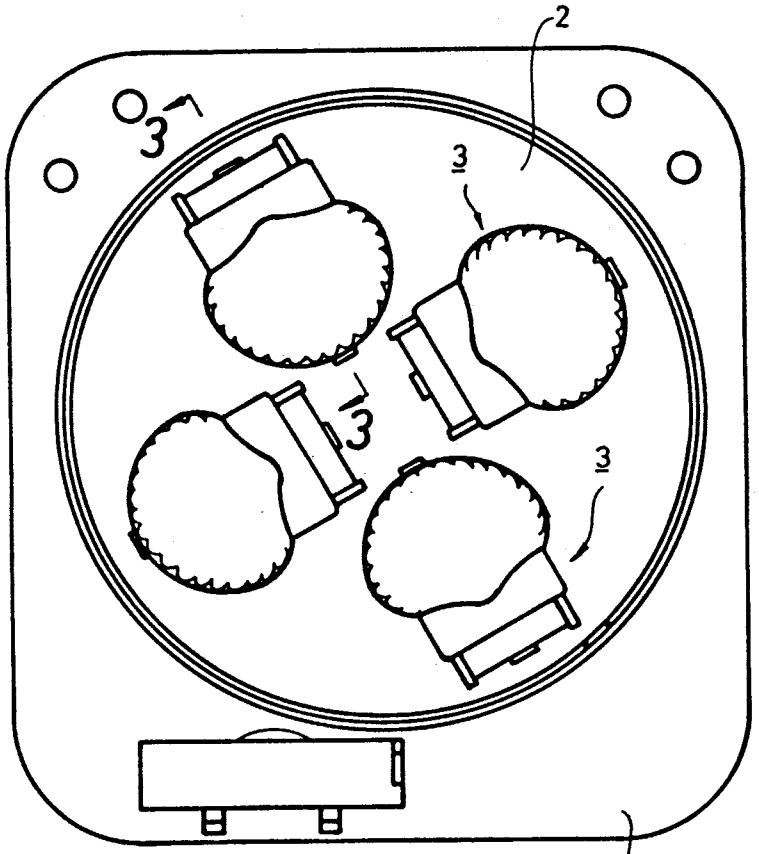
FIG. 2 is a top view of the doll catching toy in the present invention.

Each container body 31 has a chamber 314 for a doll to sit therein as shown in FIG. 3. Each doll 4 has a magnet at its top for attracting a magnet suspended on a string of a fishing rod as shown in FIG. 4. Or the doll 4 has a hole instead of a magnet in its top for engagement by a hook bound on a string of a fishing rod to hook up the doll.

Each container body 31, in addition, has a vertical through hole 315 for a slide rod 33 to fit and move up and down therein. The slide rod 33 has its bottom in contact with either the bottom surface of the receptacle or one of sloped rails 11 provided spaced apart on the bottom surface of the receptacle 1 during rotation of the turning disc 2. When the slide rod 33 comes to ride on one of the sloped rails 11, it is gradually raised up by the sloped rail 11 to push open the cap 32 as shown in FIG. 4, but the cap 32 can be opened less than 90° in its angle to the horizontal line. After the slide rod 33 moves past the highest point of the rail 11, it falls down due to its own weight on the bottom surface of the receptacle 1 so that the cap 32 also close down as shown in FIG. 3. In order to prevent the slide rod 33 from separating completely from the through hole 315 in case of the rod 33 falling down, the rod 33 has two sidewise projections 331 at the top, and the through hole 315 has sidewise projecting grooves for the projections 331 to fit therein to stop the rod 33 from separating from the hole 315.

What is claimed is:

1. A doll catching toy comprising:

a) a receptacle including a mechanism for rotating a turning disc, a bottom surface, and a plurality of sloped curved rails spaced apart on the bottom surface;

b) a turning disc placed in the receptacle for rotation by the rotating mechanism, the turning disc including a plurality of spaced large holes and a corresponding number of adjacent small holes;

c) a plurality of doll containers, each container including a container body and a cap, the container body having a hook at one side for engaging one of the small holes in the turning disc and a projection at an opposite side for extending into one of the large holes in the turning disc for firmly securing the doll container to the turning disc, a horizontal shaft pivotally securing the cap to the container body to permit the cap to open up and close down, and each container body further including a chamber for receiving a doll therein and a vertical through hole;

d) a slide rod received in each vertical through hole for up and down movement therein, the slide rod including a bottom end disposable in contact with the bottom surface of the receptacle and an upper surface of one of the sloped curved rails e) a doll disposed in the chamber of each doll container;

f) a fishing rod provided with a string and cooperating means carried by the string and each doll for permitting the fishing rod to catch the doll; and g) wherein when the turning disc is rotated by the mechanism, each slide rod is caused to slide on a sloped curved rail and gradually open the cap of the doll container to expose the doll therein for catching by the fishing rod during the period of time when the cap is in the open position.

2. The doll catching toy of claim 1 wherein the cooperating means includes magnetic means.

3. The doll catching toy of claim 1 wherein the cooperating means includes a hook carried by the string and a hole formed in each doll for engagement by the hook.

* * * * *